US009407040B2

(12) United States Patent
Matsuura et al.

(10) Patent No.: US 9,407,040 B2
(45) Date of Patent: Aug. 2, 2016

(54) CONNECTOR WITH FUNCTIONAL PORTION PROJECTING FROM SIDE SURFACE OF CONNECTOR HOSING AND TERMINAL ACCOMMODATING CHAMBER IN THE FUNCTIONAL PORTION

(71) Applicant: Sumitomo Wiring Systems, Ltd., Yokkaichi, Mie (JP)

(72) Inventors: Junya Matsuura, Mie (JP); Yoshihiro Uchiyama, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/637,482

(22) Filed: Mar. 4, 2015

(65) Prior Publication Data

US 2015/0311628 A1 Oct. 29, 2015

(30) Foreign Application Priority Data

Mar. 28, 2014 (JP) ..... 2014-068769

(51) Int. Cl.
*H01R 13/64* (2006.01)
*H01R 13/631* (2006.01)
*H01R 13/627* (2006.01)

(52) U.S. Cl.
CPC ..... *H01R 13/631* (2013.01); *H01R 13/6273* (2013.01)

(58) Field of Classification Search
CPC .. H01R 13/62; H01R 13/627; H01R 13/6272; H01R 13/6273; H01R 24/66; H01R 24/76
USPC ..... 439/374, 379, 677, 680
See application file for complete search history.

(56) References Cited

U.S. PATENT DOCUMENTS

| | | | | |
|---|---|---|---|---|
| 6,123,584 | A * | 9/2000 | Van Koetsem | H01R 13/6599 439/108 |
| 7,828,583 | B2 * | 11/2010 | Ohsumi | 439/374 |
| 7,901,218 | B2 * | 3/2011 | Sato | H01R 13/20 439/74 |
| 8,398,425 | B2 * | 3/2013 | Suzuki | H01R 12/716 439/374 |
| 9,039,428 | B2 * | 5/2015 | Sasaki | H01R 13/631 439/74 |
| 9,153,892 | B2 * | 10/2015 | Tanaka | H01R 12/7052 |
| 2003/0219999 | A1 * | 11/2003 | Minich | H01R 12/727 439/79 |
| 2006/0276061 | A1 * | 12/2006 | Koguchi | H01R 12/725 439/74 |
| 2015/0280347 | A1 * | 10/2015 | Uchiyama | H01R 13/4223 439/752 |

FOREIGN PATENT DOCUMENTS

JP 2006-012501 1/2006

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A female connector (F) includes a block-like main body (11) formed with terminal accommodating chambers (17). Projection-like functional portions (16) made of synthetic resin project from outer surfaces of the main body (11) and terminal accommodating chambers (17) are formed in the projection-like functional portions (16). Terminal fittings (40) are accommodated into the terminal accommodating chambers (17). Spaces constituting the terminal accommodating chambers (17) are present in the projection-like functional portions (16). Thus, even if the projection-like functional portions (16) are enlarged, sinks will not form in the projection-like functional portions (16) in a molding process.

15 Claims, 4 Drawing Sheets

CONNECTOR WITH FUNCTIONAL PORTION PROJECTING FROM SIDE SURFACE OF CONNECTOR HOSING AND TERMINAL ACCOMMODATING CHAMBER IN THE FUNCTIONAL PORTION

BACKGROUND

1. Field of the Invention

The invention relates to a connector.

2. Description of the Related Art

Japanese Unexamined Patent Publication No. 2006-12501 discloses a connector assembly in which a rib project on an outer surface of a female connector, a fitting groove is formed on an inner surface of a receptacle of a male connector, and the rib is pushed into the fitting groove while sliding in contact therewith to prevent prying between the female connector and the male connector when the female connector is fit into the receptacle.

The rib preferably is thickened to increase strength and to enhance the reliability of a prying preventing function by the rib. The rib and the fitting groove also have a positioning function when the female connector and the male connector are connected. A large rib is easily visible and increases the reliability of the positioning function.

However, a large thick rib is likely to have "sinks" formed during a molding process. An improperly deformed rib cannot be fit into the fitting groove and the prying preventing function may be lost. This problem occurs in connectors with a rib that has a prying preventing function, and also in connectors with projections that perform other functions.

The invention was completed based on the above situation and aims to enlarge a projection-like functional portion while avoiding the formation of sinks in a molding process.

SUMMARY OF THE INVENTION

The invention relates to a connector with a block-like main body formed with terminal accommodating chambers. A projection-like functional portion made of synthetic resin projects from an outer surface of the main body. A terminal accommodating chamber is formed in the projection-like functional portion, and terminal fittings are accommodated into the terminal accommodating chambers.

A space constituting the terminal accommodating chamber is present in the projection-like functional portion. Thus, sinks will not form in a molding process of the projection-like functional portion even if the projection-like functional portion is large.

The main body may be substantially rectangular when viewed from the front, and the projection-like functional portion may be arranged in a substantially central part of the front of the main body. According to this configuration, a diameter of a virtual circle circumscribing the connector can be made smaller as compared with the case where the projection-like functional portion is on an end part of the side of the main body. Thus, when the connector is inserted into a circular mounting hole or the like formed on a panel, an inner diameter of the mounting hole can be suppressed to a minimum dimension.

The main body may be fit into a receptacle, and the projection-like functional portion may be define a rib projecting parallel to a fitting direction into the receptacle for fitting into a groove on an inner surface of the receptacle. Engagement of the rib-like projection-like functional portion into the groove stabilizes the posture of the main body during a fitting process into the receptacle. Thus, the projection-like functional portion exhibits a prying preventing function.

DETAILED DESCRIPTION

A specific embodiment of the invention is described with reference to FIGS. 1 to 4. A female connector F of this embodiment includes a housing 10 made of synthetic resin, a front retainer 30 mounted on the housing 10, and terminal fittings 40 accommodated in the housing 10.

Figure 1:
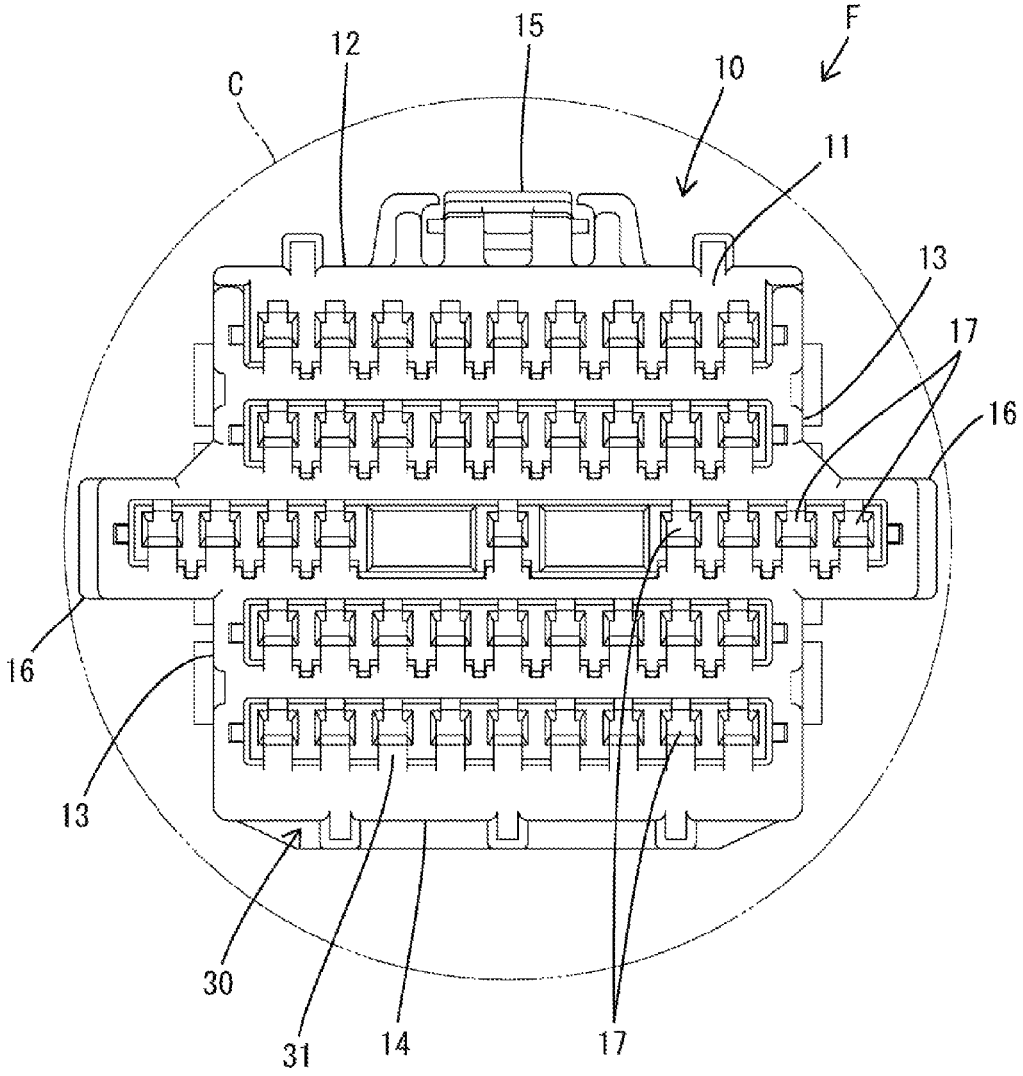
FIG. 1 is a front view of a female connector in accordance with an embodiment.
Figure 2:
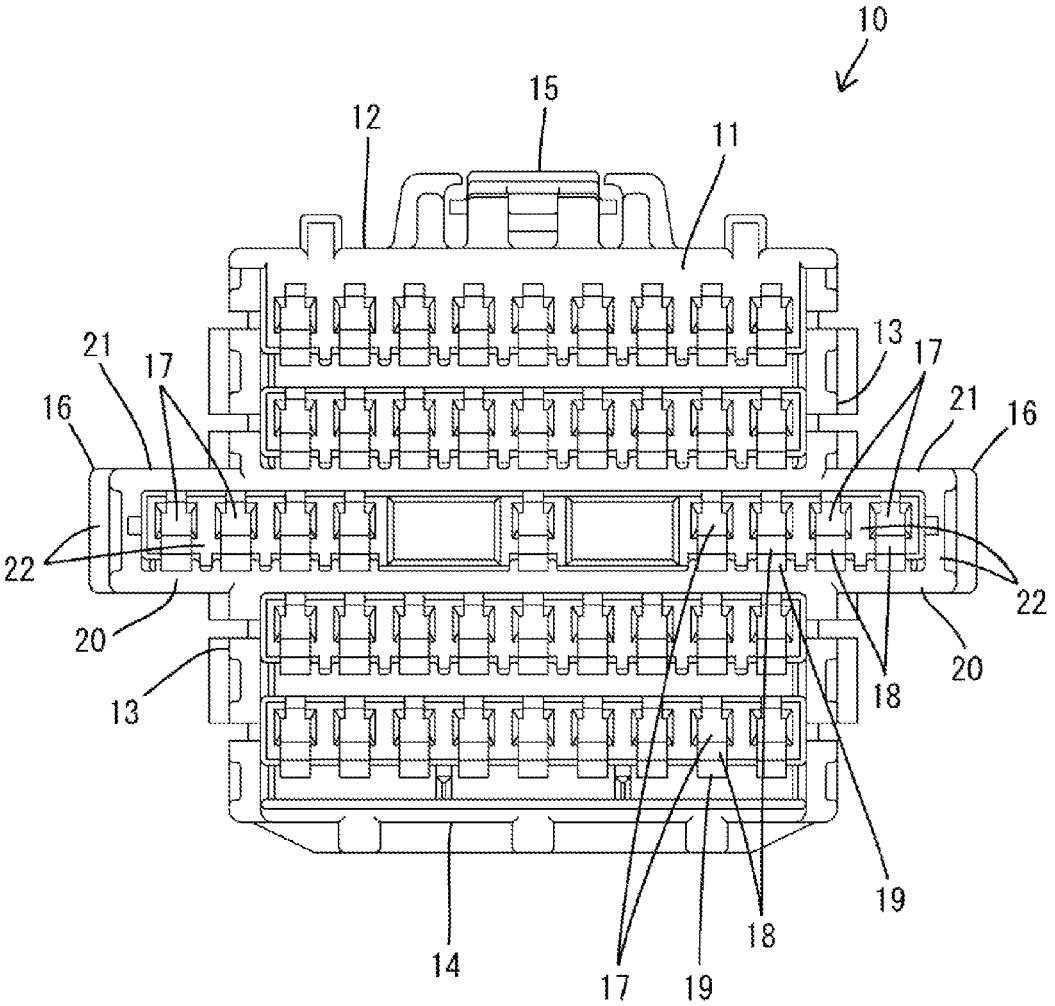
FIG. 2 is a front view of a housing of the connector.

The housing 10 includes a block-shaped main body 11 and two projection-like functional portions 16 projecting from outer surfaces of the main body 11. The main body 11 and the projection-like functional portions 16 are molded unitarily by an unillustrated mold so that the housing 10 is a single unitary component. As shown in FIGS. 1 and 2, the main body 11 is a substantially rectangular (square) in front view. This substantially rectangular shape is defined by a substantially horizontal upper surface 12, opposite left and right side surfaces 13, and a substantially horizontal lower surface 14. A lock arm 15 is located in a laterally central part of the upper surface 12.

The two projection-like functional portions 16 are bilaterally symmetrical and project outwardly in the width direction from the opposite left and right side surfaces 13. Each projection-like functional portion 16 is a substantially rectangular in front view. A height of the projection-like functional portions 16 is small, i.e. approximately ⅕ of a height of the main body 11. Further, the projection-like functional portions 16 are at central parts of the side surfaces 13 in a height direction. Projecting distances of the projection-like functional portions 16 from the main body 11 is smaller than a width of the main body 11 and is slightly larger than twice the width of terminal accommodating chambers 17 to be described later.

The projection-like functional portions 16 extend over the entire length of the main body 11 from the front end to the rear end of the main body 11. Thus, the projection-like functional portions 16 define ribs extending long and straight in the front-back direction. A length direction of the projection-like functional portions 16 is parallel to a fitting direction of the female connector F into a receptacle 51 of a male connector M. Thus, the projection-like functional portions 16 exhibit a guide function (prying preventing function) in a fitting process into the receptacle 51.

Figure 4:
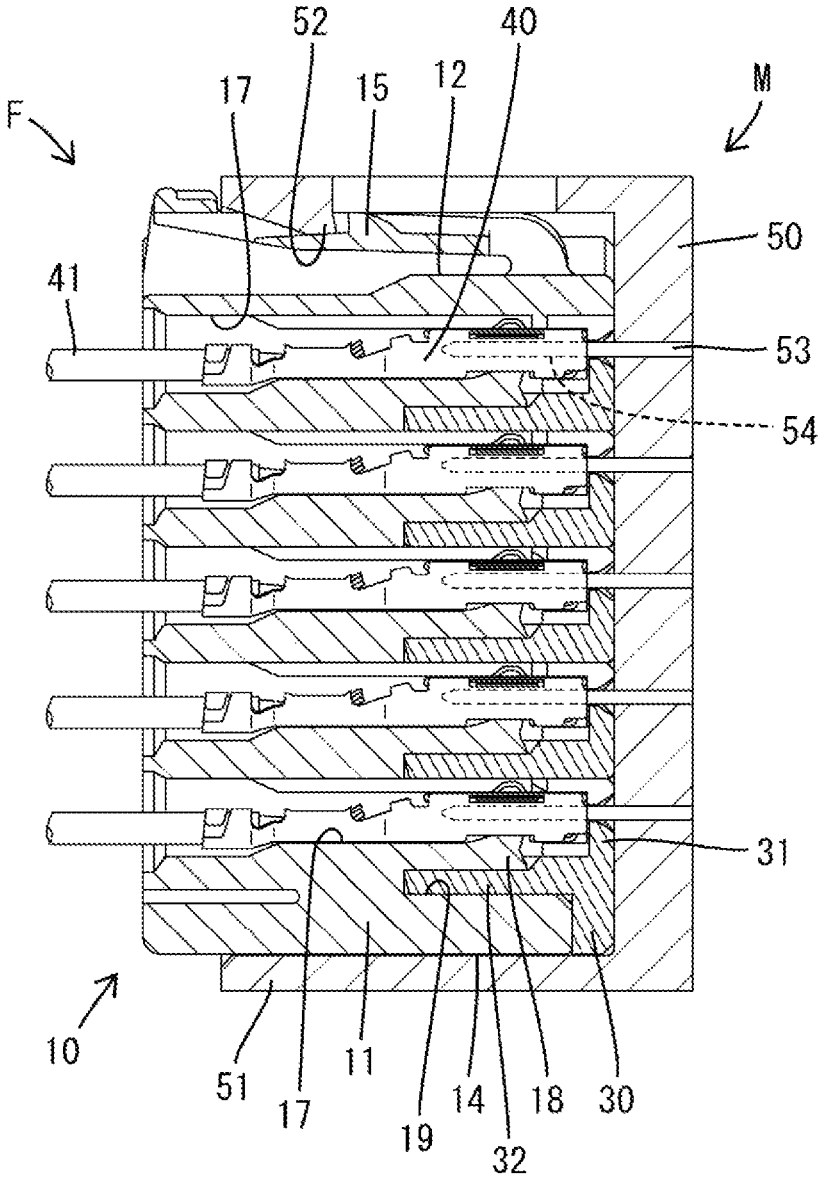
FIG. 4 is a side view in section showing a state where the female connector and the male connector are connected.

Terminal accommodating chambers 17 are formed in the main body 11. As shown in FIG. 4, a locking lance 18 is cantilevered forward along a bottom surface of each terminal accommodating chamber 17 and is unitary with the main body 11. In this embodiment, the terminal accommodating chambers 17 are arranged in five stages (i.e. an odd number of stages) separated in the vertical direction. Further, the terminal accommodating chambers 17 are arranged at constant intervals in the width direction in each stage.

Two terminal accommodating chambers 17 are formed in each of the projection-like functional portions 16 and have the same shape as those in the main body 11. The two terminal accommodating chambers 17 formed in each projection-like functional portion 16 are arranged side by side in the width direction. Further, the two terminal accommodating chambers 17 formed in the projection-like functional portion 16 are at the same height as a row of terminal accommodating chambers 17 arranged in the vertically middle stage (third stage from top) of the main body 11. Further, the arrangement interval of the terminal accommodating chambers 17 of the main body portion 11 in the width direction is set to be equal to that of the two terminal accommodating chambers 17 in the projection-like functional portion 16 in the width direction. Furthermore, an interval between the terminal accommodating chamber 17 on a widthwise end part of the main body portion 11 and the terminal accommodating chamber 17 of the projection-like functional portion 16 located on the side of the main body 11 is equal to the arrangement intervals of the terminal accommodating chambers 17 in the main body 11 and the projection-like functional portions 16.

The front retainer 30 is mounted on a front end of the housing 10. As shown in FIG. 4, the front retainer 30 includes a front wall 31 that forms front ends of the terminal accommodating chambers 17 and deflection restricting portions 32 are insertable into deflection spaces 19 for the locking lances 18. The front wall 31 corresponds to all the terminal accommodating chambers 17 of the main body 11 and all the terminal accommodating chambers 17 of the projection-like functional portions 16. Thus, a front shape of the front retainer 30 is substantially the same as that of the entire housing 10 including the main body 11 and the projection-like functional portions 16.

As shown in FIG. 4, the terminal fittings 40 are accommodated in the respective terminal accommodating chambers 17 in the housing 10. Each terminal fitting 40 is long in the front-back direction and narrow laterally. A wire 41 is connected to a rear part of the terminal fitting 40. The terminal fitting 40 is inserted into the terminal accommodating chamber 17 from behind the housing 10. The locking lance 18 interferes with the terminal fitting 40 during the insertion process and is deflected resiliently into the deflection space 19. The locking lance 18 resiliently restores when the terminal fitting 40 reaches a proper insertion position to lock the terminal fitting 40 in the respective terminal accommodating chamber 17 of the housing 10.

The front retainer 30 is held at a partial locking position on the housing 10 when inserting the terminal fittings 40 into the terminal accommodating chambers 17. The deflection restricting portion 32 is retracted forward from the deflection space 19 for the locking lance 18 when the front retainer 30 is at the partial locking position. Thus, the locking lance 18 can be deflected resiliently into the deflection space 19 and insertion of the terminal fitting 40 is not hindered. The front retainer 30 is pushed from the front and moved to a full locking position after all of the terminal fittings 40 are inserted. Thus, the deflection restricting portions 32 enter the deflection spaces 19, and displacements of the locking lances 18 in directions to separate from the terminal fittings 40 is restricted. In this way, the terminal fitting 40 is locked doubly and retained reliably.

Figure 3:
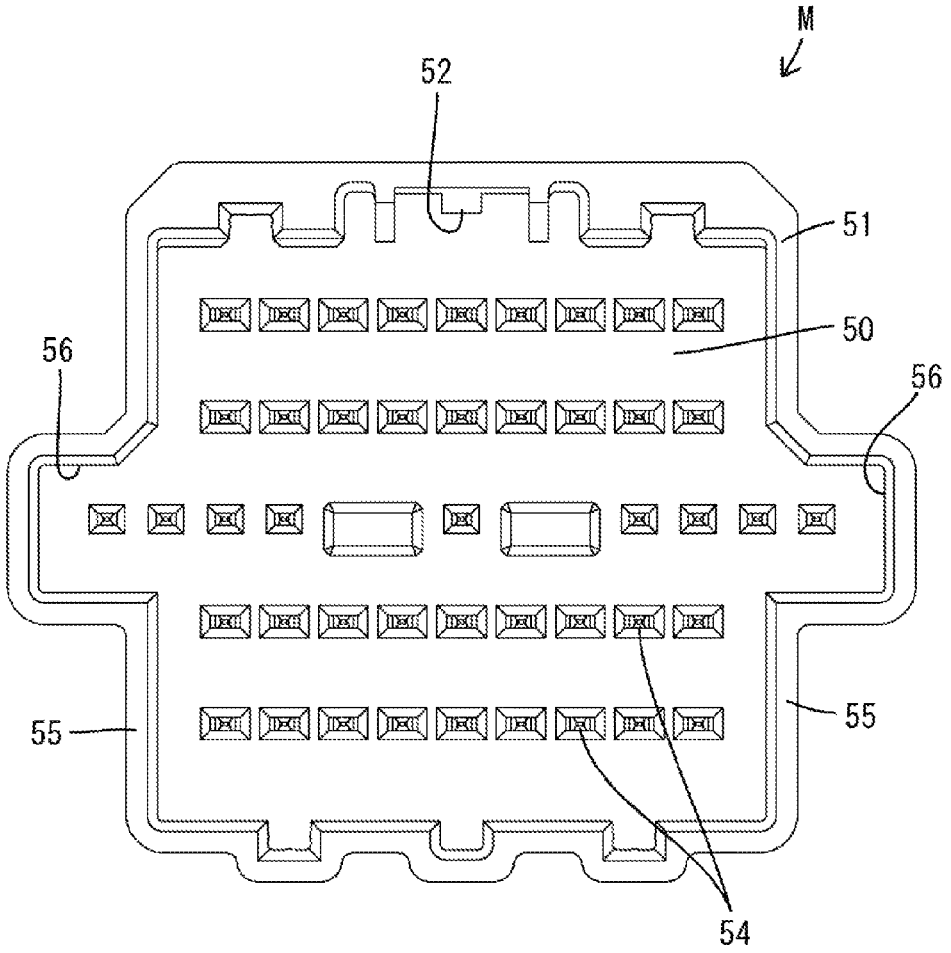
FIG. 3 is a front view of a male connector.

The male connector M includes a terminal holding portion 50 and a rectangular tubular receptacle 51 extends forward from the outer periphery of the terminal holding portion 50, as shown in FIGS. 3 and 4. Male terminals 53 are mounted in the terminal holding portion 50 and tabs 54 on the tips of the male terminals 53 are surrounded by the receptacle 51. A lock 52 projects in from an upper wall of the receptacle 51.

As shown in FIG. 3, opposite left and right side walls 55 constituting the receptacle 51 project out in the width direction to form fitting recesses 56. The fitting recesses 56 are bilaterally symmetrical and are arranged in substantially central parts of the side walls in the vertical direction (height direction). The fitting recesses 56 form grooves from the front end to the rear end of the receptacle 51 (i.e. over the entire length of the receptacle 51).

To connect the female connector F and the male connector M, the housing 10 is fit into the receptacle 51 and the projection-like functional portions 16 are fit into the fitting recesses 56. In the fitting process, the rib-like projection-like functional portions 16 slide in contact with the inner surfaces of the groove-like fitting recesses 56. Thus, the housing 10 is not inclined in the vertical direction in the receptacle 51, and the two connectors F, M are connected smoothly without binding. In the connecting process, the lock arm 15 deflects resiliently due to interference with the lock projection 52. The lock arm 15 resiliently restores to lock the lock projection 52 when the two connectors F, M are connected properly so that the two connectors F, M cannot be separated. Further, the tabs 54 are inserted into the terminal fittings 40 and connected to the terminal fittings 40 when the two connectors F, M are connected.

The strength of the projection-like functional portions 16 is increased by increasing the height of the projection-like functional portions 16 and the projecting distance thereof from the main body 11 in the width direction, thereby enhancing the reliability of a prying preventing function by the projection-like functional portions 16. The projection-like functional portions 16 also function as a positioning means when connecting the female connector and the male connector. Thus, the enlarged projection-like functional portions 16 are easily visible to increase the reliability of a positioning function. Sinks could be formed when molding enlarged projection-like functional portions 16 and could impede smooth fitting of the projection-like functional portions 16 into the fitting recesses 56, thereby losing the prying preventing function.

However, the terminal accommodating chambers 17 for accommodating the terminal fittings 40 are formed in the projection-like functional portions 16. Thus, spaces constituting the terminal accommodating chambers 17 are present in the projection-like functional portions 16, and each of the projection-like functional portions 16 has a lower wall 20, an upper wall 21 and a side wall 22. The walls are sufficiently thin to avoid forming sinks in the projection-like functional portions 16 when molding the housing 10. Accordingly, the projection-like functional portions 16 can be enlarged while avoiding the formation of sinks in the projection-like functional portions 16 in the molding process.

Further, the front view shape of the main body 11 is substantially rectangular and the projection-like functional portions 16 are at substantially central parts of the side surfaces 13 of the main body 11 in the height direction. Accordingly, a diameter of a virtual circle circumscribing the female connector F (housing 10) can be smaller as compared with the case where the projection-like functional portions 16 are on upper end parts or lower end parts of the side surface portions 13 of the main body 11. Thus, when the connector is inserted into a circular mounting hole (not shown) on a panel or the like, an inner diameter of the mounting hole can be suppressed to a minimum dimension.

Further, in the female connector F of this embodiment, the main body 11 is fit into the receptacle 51 and the projection-like functional portions 16 are in the form of ribs projecting parallel to the fitting direction into the receptacle 51. The projection-like functional portions 16 are fit into the groove-like fitting recesses 56 formed on inner surfaces of the receptacle 51. The posture of the main body 11 is stabilized by fitting the rib-like projection-like functional portions 16 into the groove-like fitting recesses 56 in the fitting process into the receptacle 51. Thus, the projection-like functional portions 16 exhibit the prying or binding preventing function.

The invention is not limited to the above described and illustrated embodiment. For example, the following embodiments also are included in the scope of the invention.

Although two terminal accommodating chambers are formed in one projection-like functional portion in the above embodiment, the number of the terminal accommodating chamber(s) formed in one projection-like functional portion may be only one or three or more.

The main body and the projection-like functional portions are formed unitarily in the above embodiment. However, they may be separate components.

Although the main body is a single body in the above embodiment, a plurality of constituent components may be united into the main body. In this case, projection-like functional portion(s) may be formed integrally on any one of the constituent components.

Two projection-like functional portions are formed in the above embodiment. However, the number of the projection-like functional portion(s) to be formed may be only one or three or more.

The projection-like functional portions are bilaterally symmetrical in the above embodiment, but they may be bilaterally asymmetrical.

Although the projection-like functional portions exhibit the prying binding preventing function in the above embodiment, they may have another function (e.g. inverted connection preventing function) in addition to the prying preventing function or may have another function without having the prying preventing function.

LIST OF REFERENCE SIGNS

F . . . female connector
11 . . . main body
13 . . . side surface
16 . . . projection-like functional portion
17 . . . terminal accommodating chamber
40 . . . terminal fitting
51 . . . receptacle
56 . . . fitting recess

What is claimed is:

1. A connector, comprising:

a housing formed from a synthetic resin and having opposite front and rear ends spaced apart along a connecting direction, the housing including:

a block-like main body extending from the front end to the rear end of the housing;

at least one functional portion extending from the front end to the rear end of the housing and defining a projection projecting from an outer surface of the main body in a direction transverse to the connecting direction; and terminal accommodating chambers extending through the housing from the front end to the rear end, one of the terminal accommodating chambers being formed in the functional portion and a plurality of the terminal accommodating chambers being formed in the main body.

2. The connector of claim 1, further comprising terminal fittings accommodated respectively in the terminal accommodating chambers.

3. The connector of claim 1, wherein:

the main body has a substantially rectangular shape when viewed from the front end of the main body; and the functional portion is arranged substantially in a central part of a side of the substantially rectangular shape of the main body.

4. The connector of claim 1, further comprising:

a receptacle configured for accommodating the main body inserted therein along the connecting direction, the receptacle being formed with at least one a groove-like fitting recess disposed and configured for slidably accommodating the functional portion along the connecting direction for guiding the main body into the receptacle along the connecting direction.

5. The connector of claim 1, wherein the terminal accommodating chambers in the main body are arranged in a plurality of rows, the functional portion and the terminal accommodating chamber therein are aligned with one of the rows of terminal accommodating chambers in the main body.

6. The connector of claim 5, wherein the plurality of rows of terminal accommodating chambers include a center row and at least one upper row offset from the center row in a first direction and at least one lower row offset from the center row in a second direction opposite to the first direction, the functional portion and the terminal accommodating chamber therein are aligned with the center row of terminal accommodating chambers in the main body.

7. The connector of claim 1, wherein the at least one functional portion comprises first and second functional portions disposed respectively on opposite sides of the main body, each of the first and second functional portions being formed with one of the terminal accommodating chambers.

8. The connector of claim 7, wherein the terminal accommodating chambers in the main body are arranged in a plurality of rows, the functional portions and the terminal accommodating chambers therein are aligned with one of the rows of terminal accommodating chambers in the main body.

9. The connector of claim 8, further comprising:

a receptacle configured for accommodating the housing that is inserted therein along the connecting direction, the receptacle being formed with first and second groove-like fitting recesses disposed and configured for slidably accommodating the respective first and second functional portions along the connecting direction for guiding the housing into the receptacle along the connecting direction.

10. The connector of claim 8, wherein the housing has a first width measured parallel to the rows at locations aligned with the functional portions and a second width measured parallel to the rows at locations on the main body offset from the functional portions, the first width being greater than the second width.

11. The connector of claim 10, wherein the housing has a first height on the main body measured transverse to the rows and transverse to the connecting direction and a second height on the functional portion measured transverse to the rows and transverse to the connecting direction, the first height being greater than the second height.

12. A connector, comprising:

a housing formed from a synthetic resin and having opposite front and rear ends spaced apart along a connecting direction, the housing including:

a block-like main body extending from the front end to the rear end of the housing, the main body having a width extending transverse to the connecting direction and a height extending transverse to the width and transverse to the connecting direction;

at least one functional portion extending from the front end to the rear end of the housing and defining a projection projecting from an outer surface of the main body in the width direction, the functional portion having a height measured parallel to the height of the main body, the height of the functional portion being less than the height of the main body; and terminal accommodating chambers extending through the housing from the front end to the rear end, one of the terminal accommodating chambers being formed in the functional portion and a plurality of the terminal accommodating chambers being formed in the main body.

13. The connector of claim 12, further comprising:

a receptacle configured for accommodating the housing inserted therein along the connecting direction, the receptacle being formed with at least one a groove-like fitting recess disposed and configured for slidably accommodating the functional portion along the connecting direction for guiding the main body into the receptacle along the connecting direction.

14. The connector of claim 12, wherein the at least one functional portion comprises first and second functional portions disposed respectively on opposite sides of the main body, each of the first and second functional portions being formed with one of the terminal accommodating chambers.

15. The connector of claim 14, wherein the terminal accommodating chambers in the main body are arranged in a plurality of rows, the functional portions and the terminal accommodating chambers therein are aligned with one of the rows of terminal accommodating chambers in the main body.

* * * * *